United States Patent [19]

Ocwieja

[11] Patent Number: 4,817,231

[45] Date of Patent: Apr. 4, 1989

[54] DURABLE TROWEL CONSTRUCTION

[75] Inventor: Thomas V. Ocwieja, Oak Brook, Ill.

[73] Assignee: Amco Tool and Stamping Co., Inc., Hillside, Ill.

[21] Appl. No.: 852,563

[22] Filed: Apr. 16, 1986

[51] Int. Cl.[4] ..... B05C 17/10; E04F 21/16

[52] U.S. Cl. ..... 15/235.4; 15/143 R

[58] Field of Search ..... 15/235.3, 235.4, 235.5, 15/235.6, 235.7, 235.8, 236 R, 143 R; 38/88, 90, 91, 92; 16/114 R, 110 R; 425/458; 294/57; 190/115; 403/219, 384, 388, 398, 230, 262, 180, 188, 198, 199, 192, 187; 81/489, 492; 172/371, 374; 7/114, 115, 116, 167

[56] References Cited

U.S. PATENT DOCUMENTS

| | | | |
|---|---|---|---|
| 92,506 | 7/1869 | Ault | 15/235.4 |
| 1,021,945 | 4/1912 | Newton | 15/235.4 |
| 1,111,433 | 9/1914 | Brandstrom | 15/235.4 |
| 1,550,296 | 8/1925 | Weiland | 15/235.4 |
| 2,410,343 | 10/1946 | Haivala | 15/235.6 |
| 3,045,271 | 7/1962 | Cinotti | 15/235.7 X |
| 3,174,227 | 3/1965 | House | 15/235.4 X |
| 3,198,565 | 8/1965 | Ellis | 294/57 X |
| 3,346,905 | 10/1967 | Scarpelli | 15/235.6 |
| 3,460,183 | 8/1969 | Harrington | 403/384 X |
| 4,224,713 | 9/1980 | Trent | 15/235.4 |
| 4,399,583 | 8/1983 | Jarvis | 15/235.8 |
| 4,467,492 | 8/1984 | Eugene | 15/235.4 |

FOREIGN PATENT DOCUMENTS

| | | | |
|---|---|---|---|
| 1287300 | 1/1969 | Fed. Rep. of Germany | 15/360 |
| 2204941 | 8/1973 | Fed. Rep. of Germany | 81/323 |

*Primary Examiner*—Harvey C. Hornsby
*Assistant Examiner*—Scott J. Haugland
*Attorney, Agent, or Firm*—Jenner & Block

[57] ABSTRACT

A trowel of durable construction is provided. The trowel includes a cap member stamped from metal to form a raised hollow rib in a top surface and projections in a bottom surface. An aperture formed through the raised rib member allows a cap attachment portion of a handle support member to be received within the hollow member while the remaining portion of the handle support member extends out through the aperture. The cap attachment end is projection welded to the hollow rib member. The bottom surface of the cap member is then projection-welded to a generally planar blade member having a side adapted for troweling. The combination of stamped components attached by projection welding to a trowel blade provides a strong, durable, long lasting trowel of economic construction.

21 Claims, 1 Drawing Sheet

DURABLE TROWEL CONSTRUCTION

TECHNICAL FIELD

The present invention relates to a trowel and more particularly to a durable trowel of very strong construction while being economical to produce.

BACKGROUND OF THE INVENTION

Trowels are known in which the individual parts are formed by casting. In particular, the handle connection member (that portion joining a handle to a blade of a trowel) is cast as a single member. Casting is an expensive and time consuming operation in which a mold must be created for each member produced. Molten metal is poured into the mold and then allowed to cool. After cooling the molds are opened and the castings removed. The casting must then be machined or otherwise worked to produce the required finish. Each step is labor intensive thereby adding to the cost and time it takes to produce a trowel. Finished castings can be spot welded or otherwise secured to a row of studs that are welded to the trowel blade. Such a construction is relatively complicated and expensive.

In an attempt to produce trowels at a cheaper cost, it has been known to construct the handle connection member by forming a strip of metal into substantially a "U" shape. One end of the member is then attached to the trowel blade by either spot welding or projection welding. A handle is then attached to the other end of the member. This type of construction, however, produces a relatively weak handle connection and is limited to flimsy, disposable type trowels.

SUMMARY OF THE INVENTION

In accordance with the present invention, an improved trowel is provided that is of very strong construction and is economically produced. Use of a casting operation is avoided. The trowel of the present invention includes a handle connection member comprising two separate pieces, preferably joined by projection welding. One piece is a cap member that is stamped from steel. The second piece is a handle support formed from a steel rod. When formed in the manner of the present invention and projection welded together, the two elements form a handle connection member as strong or stronger than a one-piece cast handle connection member. However, components produced by stamping can be produced more rapidly and economically than components produced by casting. This enables the manufacture of durable, long lasting trowels at an economic price.

These and other objects and advantages of the invention, as well as details of an illustrative embodiment, will be more fully understood from the following description and from the drawings.

DETAILED DESCRIPTION

Figure 1:
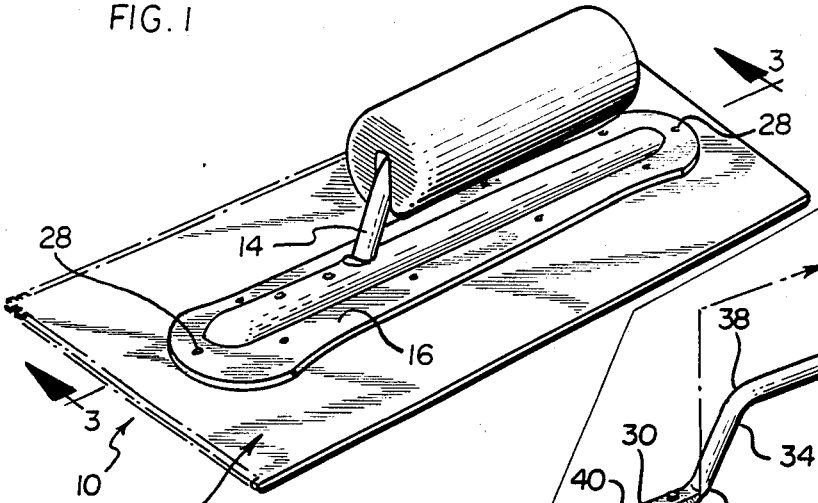
FIG. 1 is a perspective view of the preferred embodiment of the present invention.

The hand tool of FIG. 1 comprises a trowel 10 having a generally planar blade member 12 adapted for troweling secured to a handle support member 14 by a cap member 16. The trowel blade can be of any desired configuration, such as triangular or rectangular and may be a cement, brick or plastering trowel blade, for example.

Figure 2:
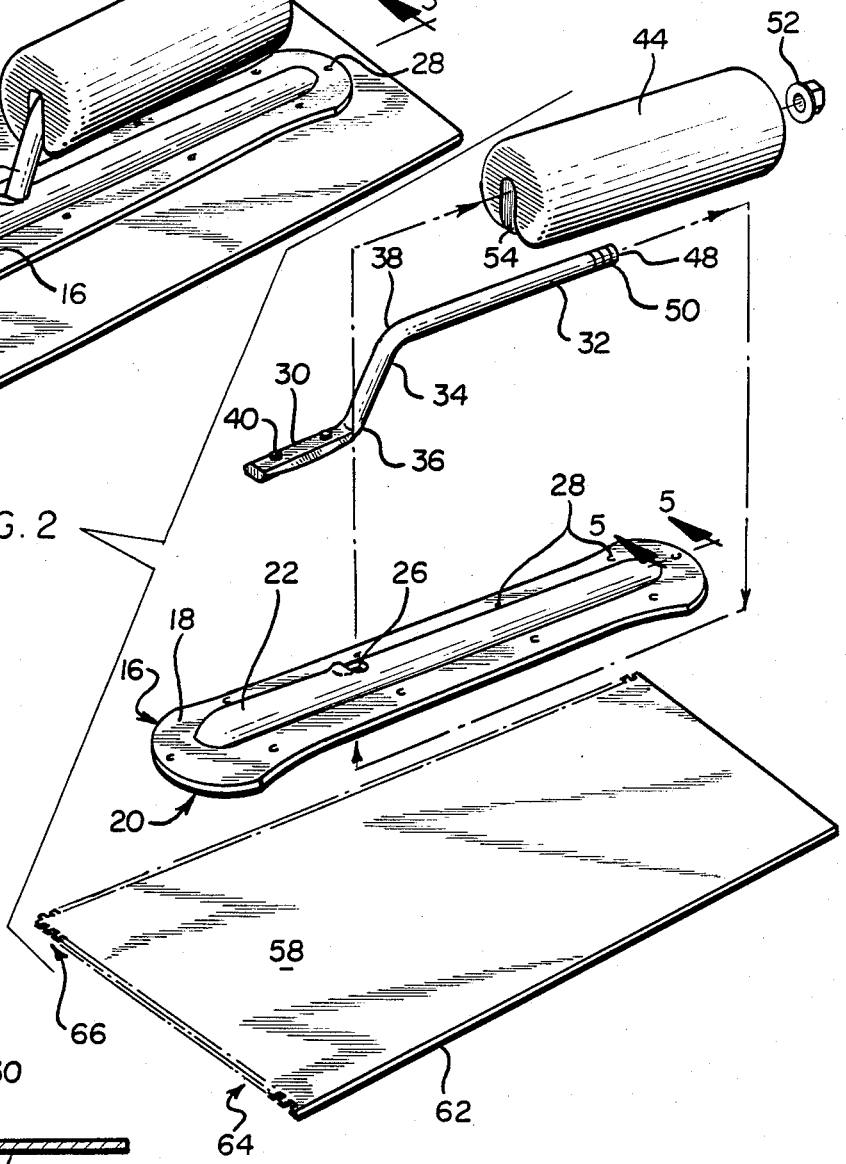
FIG. 2 is an exploded view of the present invention.
Figure 4:
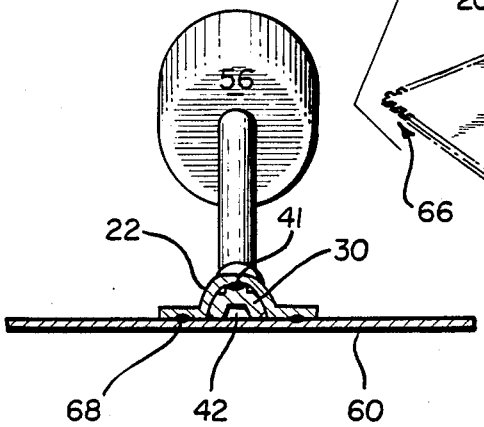
FIG. 4 is a sectional view taken substantially along line 4—4 of FIG. 3.
Figure 3:
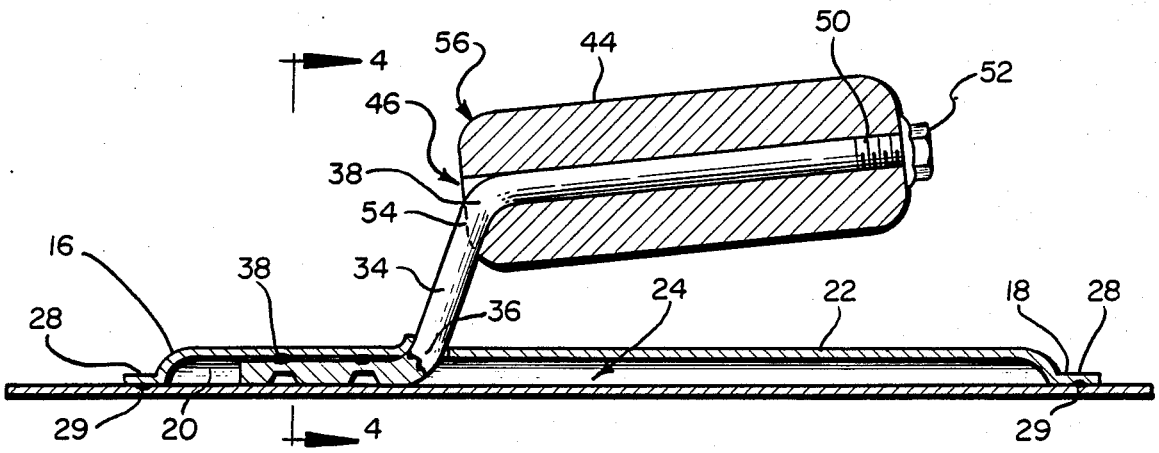
FIG. 3 is a sectional view taken substantially along line 3—3 in FIG. 1.

As more clearly shown in FIGS. 2–4, cap 16, formed from an elongated oval sheet having a length substantially greater than its width, has a top surface 18 and a bottom surface 20. Cap 16 may be formed of any metallic material suitable for a stamping operation. Preferably, however, cap 16 is stamped 14 gauge steel of suitable carbon content. A raised hollow rib 22 is formed in top surface 18 by the stamping operation. The hollow portion of the rib faces downwardly towards the surface of the blade to which the cap is attached. Rib 22 runs substantially the length of cap 16 and has a corresponding channel 24 in bottom surface 20. Rib 22 further has an aperture 26 formed therethrough to allow access to channel 24.

Figure 5:
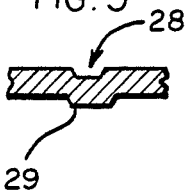
FIG. 5 is a sectional view taken substantially along line 5—5 of FIG. 2.

The stamping operation also produces a plurality of indentations 28 in top flat peripheral surface 18 around raised rib 22. Each indentation 28 in top surface 18 produces a corresponding boss or projection 29 (FIG. 5) in bottom peripheral surface 20. The projections on bottom surface 20 enable cap member 16 to be attached to blade 12 by projection welding as will be explained below.

Handle support member 14 can be conveniently obtained by appropriately bending a straight steel or metal rod and includes a cap attachment end 30 and a handle attachment end 32 spaced by an intermediate leg portion 34. Leg portion 34 has two oppositely directed arcuate bends, or knees, of less than 90°. A first knee 36 defines the transition between cap attachment end 30 and leg 34. A second knee 38 extends opposite the direction of first knee 36 and defines the transition between handle attachment end 32 and leg 34. Handle support member 14 is thereby formed such that cap attachment end 30 and handle attachment end 32 occupy different planes that are spaced by leg 34 and which extend substantially parallel to each other.

Cap attachment end 30 is formed by a stamping operation. After stamping, cap attachment end 30 substantially corresponds to the shape within hollow rib 22. That is, it corresponds to channel 24. In this manner, cap attachment end 30 can be positioned in a complementary nesting relationship within rib 22 substantially filling a portion of channel 24.

The stamping operation of cap attachment end 30 also produces a boss 40 on cap attachment end 30 opposite an indentation 42. Indentation 42, stamped into cap attachment end 30, produces a displacement of material that forms boss 40. The bosses enable cap attachment end 30 to be projection welded to cap member 16 as will be explained below.

As depicted by the arrow in FIG. 2, handle support member 14 is inserted through aperture 26 by way of bottom surface 20. Aperture 26 is only slightly larger in diameter than handle attachment end 32 which passes through aperture 26 first. Cap attachment end 30 will not pass through aperture 26 due to its stamped shape which conforms to channel 24.

Turning to FIG. 3, it can be seen how cap attachment end 30 nests in channel 24 extending parallel to rib 22.

First knee 36 occupies aperture 26 with leg 34 projecting out and away from cap 16.

With cap attachment end 30 inside rib 22, boss 40 is brought into contact with bottom surface 20 of channel 24. A current is then applied between boss 40 and top surface 18. This produces current flow and heating which is localized at the contact point between the boss and the bottom surface. As shown in FIGS. 3 and 4, boss 40 is flattened to form a cap-support weld bead 41 leaving substantially zero sheet separation between cap attachment end 30 and bottom surface 20 of cap 16. Upon completion of the projection welding process, attachment end 30 substantially fills channel 24 for the full length that cap attachment end 30 projects into channel 24. The combination of specially formed cap attachment end 30 projection welded to cap 16 produces a handle connection member about as strong or stronger as one formed by one-piece casting without being brittle.

Referring again to FIG. 3 it can be seen how handle attachment end 32 is arranged for carrying a handle 44. Handle 44 could be constructed from plastic or metal, however, in the preferred embodiment it is constructed of wood. A bore 46 extends generally axially through the entire length of handle 44. Handle attachment end 32 is of sufficient length to extend through the entire length of handle 44 and to allow a distal end 48 (FIG. 2) to project out of handle 44. Distal end 48 has a plurality of threads 50 arranged and configured to correspond with the threads of a threaded fastener member 52, such as a nut, to secure handle 44 to handle attachment end 32.

To prevent handle 44 from rotating about handle attachment end 32, a groove 54 is formed in a front end 56 of handle 44. Groove 54 cooperates with handle support member 14 to lock handle 44 in a fixed position on handle attachment end 32. As shown in FIG. 3, groove 54 is of a sufficient depth to receive second knee 38 at least partially within handle 44. In this manner leg 34 provides a stop to prevent a rotation of handle 44 on handle attachment end 32.

While a great variety of means to hold handle 44 on handle attachment end 32 could be used, a locking nut is the preferred method. The use of a simple but efficient locking nut allows a user convenient means to remove an old handle and replace it with a new handle should the need arise.

Now turning to FIG. 2, it can be seen that trowel blade 12 has an attachment side 58. Opposite attachment side 58 is a substantially smooth side 60 adapted for troweling. The blade may be used for a cement trowel, a plastering trowel, or a brick trowel depending on the shape of the blade and how the edges of the blade are formed. The trowel blade may have a smooth edge 62, a patterned edge 64 or a combination of both.

Generally, where there is a pattern, the pattern will comprise a plurality of notches 66. The size and shape of the notches determine the use to which the trowel may be put. Regardless of the use intended, cap member 16 can be fixed to attachment side 58 by projection welding.

Projections 29 on bottom surface 20, formed by the stamping operation of cap 16 as described above, are brought into contact with attachment surface 58. When a welding current is applied, the bosses or projections are flattened to form a cap-blade weld bead 68 between bottom surface 20 and attachment surface 58. Flattening of the projections leaves substantially zero sheet separation between bottom surface 20 and attachment surface 58.

In use, cap 16 provides a strong durable attachment means for securing a handle support to a blade. Force applied to the the handle or blade is dispersed through the length and width of cap 16. This substantially prevents load forces from localizing and fracturing a weld. Further, raised rib 22 provides support to projecting leg 34 at first knee 36, particularly when downward pressure is applied to handle 44. These improvements make trowel 10 a sturdy, durable, long lasting hand tool. In addition the use of stamped components joined by projection welding provides for an economically produced trowel having the strength of a trowel formed by casting.

While the invention has been described in connection with preferred embodiments, it will be understood that it is not intended to limit the invention to these embodiments. On the contrary, it is intended to cover all alternatives, modifications and equivalents as may be included in the spirit and scope of this invention as defined by the appended claims.

What is claimed is:

1. A trowel comprising:

a generally planar blade member having a side adapted for troweling;

a cap member having a top surface and a bottom peripheral surface, the bottom peripheral surface defining a flat lip adapted for and being attached to said planar blade member opposite to said side adapted for troweling, said cap member including a raised hollow rib formed in said top surface and extending substantially the length of said cap member, the hollow portion of said rib facing downwardly, said hollow rib having an aperture extending through a top surface of said rib between the ends of said rib;

a handle;

a handle support member having a cap attachment end disposed within and secured to said hollow rib, a handle attachment end opposite said cap attachment end carrying said handle, and an intermediate leg portion between said cap attachment end and said handle attachment end extending through said aperture; and means for securing said handle to said handle support member.

2. The trowel of claim 1 wherein said blade member has at least three edges.

3. The trowel of claim 1 wherein said blade member has at least one edge having a plurality of notches.

4. The trowel of claim 1 wherein said blade member is a plastering trowel blade.

5. The trowel of claim 1 wherein said cap is a stamped metallic member.

6. The trowel of claim 1 wherein said cap is stamped steel.

7. The trowel of claim 1 wherein said bottom surface of said cap is attached to said blade member by projection welding.

8. The trowel of claim 1 wherein said handle support member is a steel rod.

9. The trowel of claim 1 wherein said cap attachment end of said handle support member nests within said hollow rib.

10. The trowel of claim 1 wherein said cap attachment end is secured to said hollow rib by projection welding.

11. The trowel of claim 1 wherein said cap attachment end of said handle support member nests within said hollow rib substantially filling said hollow rib for the length of said cap attavchment end.

12. The trowel of claim 1 wherein said handle support member is arranged such that said cap attachment end extends substantially parallel to said handle attachment end.

13. The trowel of claim 1 wherein said handle has a bore extending generally axially through the entire length of said handle, and said handle attachment end extends through said bore and includes a threaded fastener member on a distal end thereof to secure said handle on said handle support member.

14. The trowel of claim 1 further comprising means for preventing rotation of said handle with respect to said handle support member comprising a groove formed in a front face of said handle arranged and configured to cooperate with said handle support member such that a portion of said handle support member is received in said groove to lock said handle in a fixed position in relation to said handle attachment end.

15. The trowel of claim 1 wherein said means for securing said handle to said handle support comprises fastener means at a distal end of said handle attachment end.

16. The trowel of claim 15 wherein said fastener means includes a threaded fastener on said distal end.

17. The trowel of claim 1 wherein said raised rib supports said leg projecting through said aperture.

18. A trowel comprising:

a trowel blade;

a cap member of stamped metal having a top surface and a bottom peripheral surface, the bottom surface defining a flat lip projection welded to said trowel blade, said cap member including a raised hollow rib member formed in said top surface, the hollow portion of said rib facing dowwnardly, said hollow rib having an aperture extending through said top surface of said rib between the ends of said rib;

a handle support member formed of a metal rod having a cap attachment end and a handle support end joined by an intermediate leg portion, said cap attachment end being within, nesting with and attached to said hollow rib by projection welding and the intermediate leg portion extending through the aperture; and a handle arranged to receive and be fixed on said handle support end.

19. The trowel of claim 18 wherein said cap member is an elongated oval having a length substantially greater than its width.

20. The trowel of claim 18 wherein said cap attachment end is formed by stamping.

21. The trowel of claim 1 wherein said blade member is a cement trowel blade.

* * * * *